US006119284A

United States Patent [19]

Cosman

[11] Patent Number: 6,119,284

[45] Date of Patent: Sep. 19, 2000

[54] FLOATING POOL COVER SUPPORT

[76] Inventor: Derek Cosman, 683 Adelaide Ave., Oshawa, Ontario, Canada, L1G 2A7

[21] Appl. No.: 09/301,731

[22] Filed: Apr. 29, 1999

[51] Int. Cl.[7] ..... E04H 4/00

[52] U.S. Cl. ..... 4/498; 4/499; 4/503

[58] Field of Search ..... 4/498, 499, 503; 220/216, 220; 135/90, 123, 124, 139, 906; 150/154; 441/38, 44, 45, 129, 130, 131; 114/39.1, 39.2, 292, 345, 357, 263

[56] References Cited

U.S. PATENT DOCUMENTS

| | | | |
|---|---|---|---|
| 1,226,274 | 5/1917 | Sweeny | 441/45 |
| 2,162,134 | 6/1939 | Squier | 441/130 |
| 4,593,640 | 6/1986 | Blunschi | 114/292 |
| 4,722,329 | 2/1988 | Kalvag | 441/129 |
| 4,854,257 | 8/1989 | Grayson | 114/61 |

FOREIGN PATENT DOCUMENTS

| | | |
|---|---|---|
| 353901 | 2/1990 | European Pat. Off. . |
| 599872 | 5/1978 | Sweden . |

*Primary Examiner*—Steven O. Douglas
*Assistant Examiner*—Khoa D. Huynh

[57] ABSTRACT

A floating pool cover support for suspending a pool cover above the surface of the water. The floating pool cover support includes a pair of spaced apart base members. A pair of float tubes surround the base members, each having a specific gravity less than that of water. Each of the base members has a first arm extending upwardly therefrom. A pair of angled members are coupled to the base members. A central portion is coupled to the angled members.

11 Claims, 2 Drawing Sheets

FLOATING POOL COVER SUPPORT

BACKGROUND OF THE INVENTION

1. Field of the Invention

The present invention relates to pool cover supports and more particularly pertains to a new floating pool cover support for suspending a pool cover above the surface of the water.

2. Description of the Prior Art

The use of pool cover supports is known in the prior art. More specifically, pool cover supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,000,527; U.S. Pat. No. 5,690,133; U.S. Pat. No. 4,847,925; U.S. Pat. No. 3,366,977; U.S. Pat. No. 4,685,254; and U.S. Pat. No. Des. 358,184.

While these devices fulfill their respective, particular objectives and requirements, the aforementioned patents do not disclose a new floating pool cover support. The inventive device includes a pair of spaced apart base members. A pair of float tubes surround the base members, each having a specific gravity less than that of water. Each of the base members has a first arm extending upwardly therefrom. A pair of angled members are coupled to the base members. A central portion is coupled to the angled members.

In these respects, the floating pool cover support according to the present invention substantially departs from the conventional concepts and designs of the prior art, and in so doing provides an apparatus primarily developed for the purpose of suspending a pool cover above the surface of the water.

SUMMARY OF THE INVENTION

In view of the foregoing disadvantages inherent in the known types of pool cover supports now present in the prior art, the present invention provides a new floating pool cover support construction wherein the same can be utilized for suspending a pool cover above the surface of the water.

The general purpose of the present invention, which will be described subsequently in greater detail, is to provide a new floating pool cover support apparatus and method which has many of the advantages of the pool cover supports mentioned heretofore and many novel features that result in a new floating pool cover support which is not anticipated, rendered obvious, suggested, or even implied by any of the prior art pool cover supports, either alone or in any combination thereof.

To attain this, the present invention generally comprises a pair of spaced apart base members. A pair of float tubes surround the base members, each having a specific gravity less than that of water. Each of the base members has a first arm extending upwardly therefrom. A pair of angled members are coupled to the base members. A central portion is coupled to the angled members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new floating pool cover support apparatus and method which has many of the advantages of the pool cover supports mentioned heretofore and many novel features that result in a new floating pool cover support which is not anticipated, rendered obvious, suggested, or even implied by any of the prior art pool cover supports, either alone or in any combination thereof.

It is another object of the present invention to provide a new floating pool cover support which may be easily and efficiently manufactured and marketed.

It is a further object of the present invention to provide a new floating pool cover support which is of a durable and reliable construction.

An even further object of the present invention is to provide a new floating pool cover support which is susceptible of a low cost of manufacture with regard to both materials and labor, and which accordingly is then susceptible of low prices of sale to the consuming public, thereby making such floating pool cover support economically available to the buying public.

Still yet another object of the present invention is to provide a new floating pool cover support which provides in the apparatuses and methods of the prior art some of the advantages thereof, while simultaneously overcoming some of the disadvantages normally associated therewith.

Still another object of the present invention is to provide a new floating pool cover support for suspending a pool cover above the surface of the water.

Yet another object of the present invention is to provide a new floating pool cover support which includes a pair of spaced apart base members. A pair of float tubes surround the base members, each having a specific gravity less than that of water. Each of the base members has a first arm extending upwardly therefrom. A pair of angled members are coupled to the base members. A central portion is coupled to the angled members.

Still yet another object of the present invention is to provide a new floating pool cover support that eliminates the pools and debris that collect on a partially sunken cover.

Even still another object of the present invention is to provide a new floating pool cover support which could be used to support a volleyball net or basketball hoop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
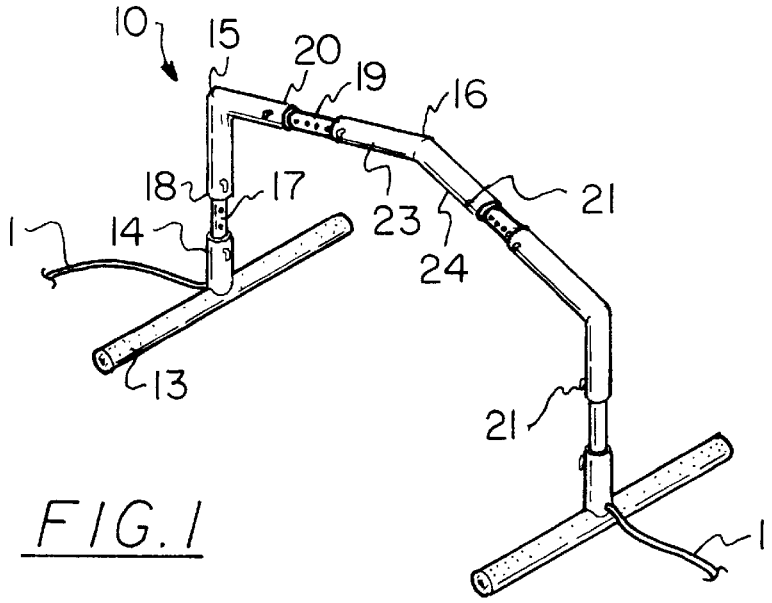
FIG. 1 is a schematic perspective view of a new floating pool cover support according to the present invention.
Figure 2:
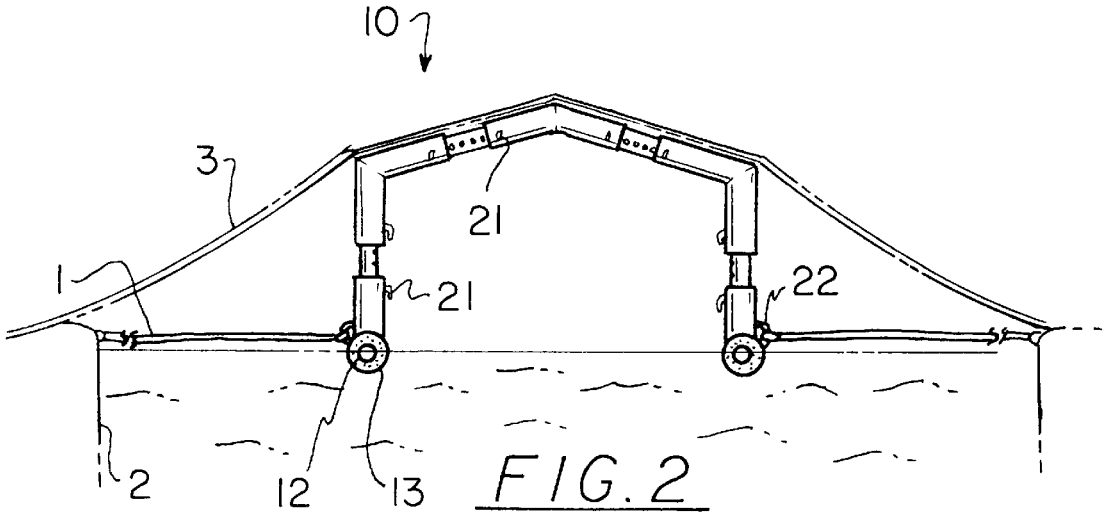
FIG. 2 is a schematic side view of the present invention.
Figure 3:
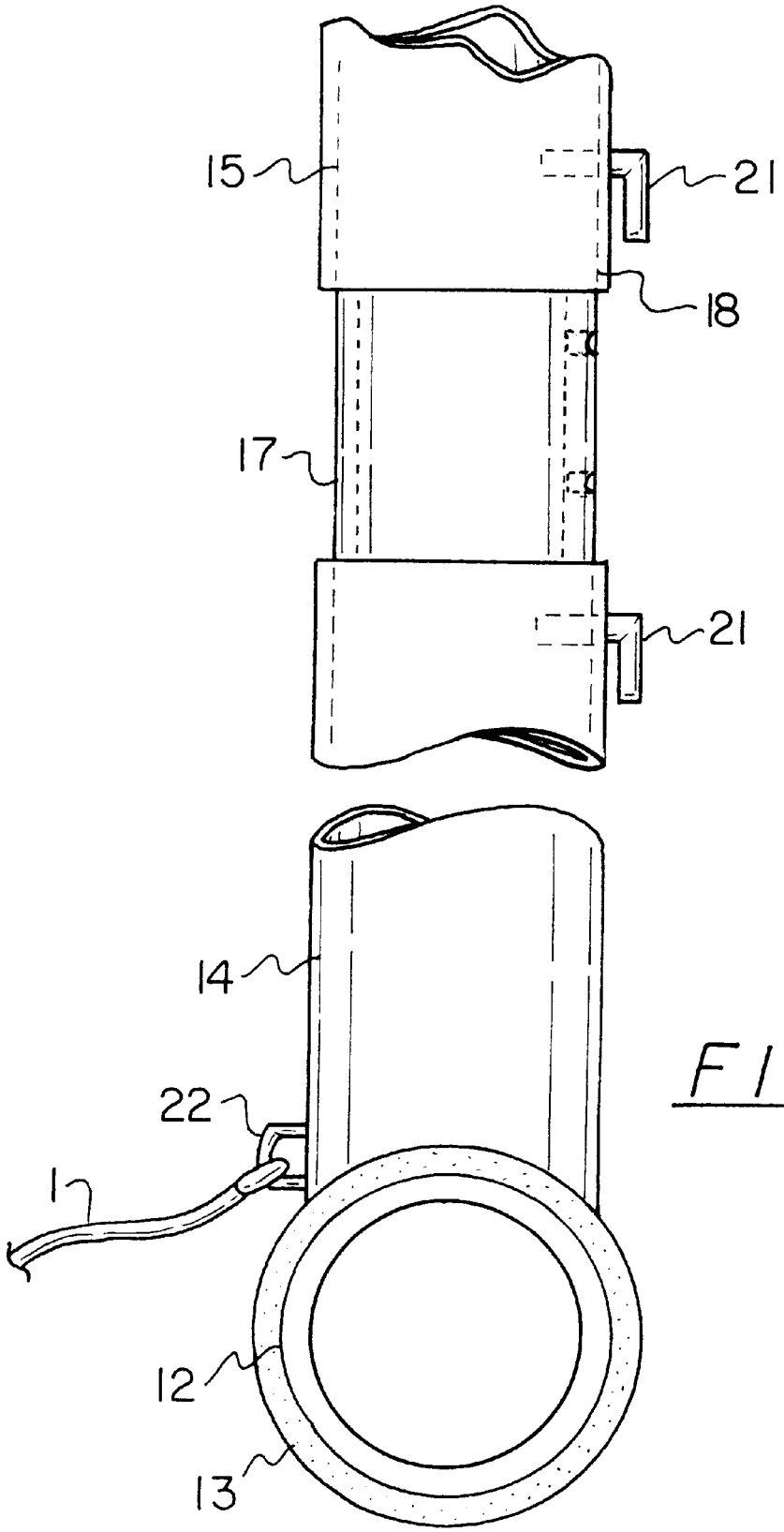
FIG. 3 is a schematic detailed view of the present invention.

With reference now to the drawings, and in particular to FIGS. 1 through 3 thereof, a new floating pool cover support embodying the principles and concepts of the present invention and generally designated by the reference numeral 10 will be described.

As best illustrated in FIGS. 1 through 3, the floating pool cover support 10 generally comprises a pair of spaced apart base members 12. A pair of float tubes 13 surround the base members, each having a specific gravity less than that of water. Each of the base members has a first arm 14 extending upwardly therefrom. A pair of angled members 15 are coupled to the base members. A central portion 16 is coupled to the angled members.

Preferably, the base members extend generally horizontally and are oriented generally parallel each other. The float tubes may be fixed to the base members by an adhesive. Ideally, the first arms extend generally vertically from the base members.

Preferably, a pair of first extension members 17 are telescopically received in open ends of the first arms of the base members. Open lower ends 18 of the angled members telescopically receive the first extension members. The first extension members are positionable along the first arms and the angled members to adjust the height of the angled members with respect to the base members.

Also preferably, in combination with the first extension members or used without first extension members, a pair of second extension members 19 are telescopically received in open upper ends 20 of the angle members. The central portion is tubular and telescopically receives the second extension members. The second extension members are positionable along the central portion and the angled members to adjust the spacing of the base members with respect to the each other.

Ideally, each of the first extension members has a row of apertures extending therealong between its ends. Each of the first arms has an aperture therethrough positioned towards the open ends thereof. A pair of pins 21 extend through the apertures of the first arms and the first extension members for preventing sliding of the first extension members with respect to the first arms.

Each of the angled members has an aperture therethrough positioned towards the lower ends thereof. A second pair of pins extend through the apertures of the angled arms and the first extension members for preventing sliding of the first extension members with respect to the angled arms.

Also ideally, each of the second extension members has a row of apertures extending therealong between its ends. Each of the angled members has a hole therethrough positioned towards the upper ends thereof. A third pair of pins extend through the holes of the angled members and the apertures of the second extension members for preventing sliding of the second extension members with respect to the angled members.

The central portion has a pair of apertures therethrough positioned towards opposite ends thereof. A fourth pair of pins extend through the apertures of the angled arms and the first extension members for preventing sliding of the second extension members with respect to the central portion.

Preferably, each of the first arms has a loop 22 coupled thereto adapted for receiving a tether line 1 therethrough for coupling the support to walls of a swimming pool 2 so that the support does not float around the pool.

The preferred outer diameter of the float tubes is about 5 inches. The preferred length of each of the float tubes is 4 feet long. These dimensions have been found to provide enough buoyancy to hold a wet pool cover above the surface of the pool water.

The preferred length of each of the arms is between about 6 and 12 inches. The preferred length of each of upper and lower portions of the angled members is between about 10 and 18 inches. The preferred length of each of first and second portions 23,24 of the central portion is between about 10 and 18 inches. The preferred length of each of the extension members is about 18 inches.

The preferred angle of each of the angled members between their upper and lower portions is about 92.5 degrees. The preferred angle of each of the first and second portions of the central portions from the horizontal is about 5 degrees. These angles prevent rainwater from accumulating on the pool cover, especially when more than one support device is used.

In use, the pins are removed. The angled members are positioned to the desired height with respect to the base members. The first and second pairs of pins are placed in the respective apertures. The angled members are positioned at the desired distance from the central portion and the third and fourth pairs of pins are placed in the respective holes and apertures. Tether lines are coupled to the loops. A pool cover 3 is pulled over the support device and attached to sides of the swimming pool or other water container.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support device for suspending a pool cover above a surface of water, the device comprising:

a pair of spaced apart base members;

a pair of float tubes surrounding said base members, each of said float tubes having a specific gravity less than that of water;

each of said base members having a first arm extending upwardly therefrom;

a pair of angled members coupled to said base members;

a central portion coupled to said angled members; and a pair of first extension members being telescopically received in open ends of said first arms of said base members, said angled members having open lower ends, said lower ends of said angled members telescopically receiving said first extension members.

2. The support device of claim 1, wherein said base members extend generally horizontally and are oriented generally parallel each other.

3. The support device of claim 1, wherein said first extension members each have a row of apertures extending therealong, each of said first arms having an aperture therethrough positioned towards said open ends thereof, a pair of pins extending through said apertures of said first arms and said first extension members for preventing sliding of said first extension members with respect to said first arms, each of said angled members having an aperture therethrough positioned towards said lower ends thereof, a second pair of pins extending through said apertures of said angled arms and said first extension members for preventing sliding of said first extension members with respect to said angled arms.

4. The support device of claim 1, further comprising a pair of second extension members being telescopically received in open upper ends of said angle members, said central portion telescopically receiving said second extension members.

5. The support device of claim 4, wherein said second extension members each have a row of apertures extending therealong, each of said angled members having a hole therethrough positioned towards said upper ends thereof, a third pair of pins extending through said holes of said angled members and said apertures of said second extension members for preventing sliding of said second extension members with respect to said angled members, said central portion having a pair of apertures therethrough positioned towards opposite ends thereof, a fourth pair of pins extending through said apertures of said angled arms and said first extension members for preventing sliding of said second extension members with respect to said central portion.

6. The support device of claim 1, wherein each of said first arms has a loop coupled thereto adapted for receiving a tether line therethrough.

7. A support device for suspending a pool cover above a surface of water, the device comprising:

a pair of spaced apart base members extending generally horizontally and oriented generally parallel each other;

a pair of float tubes surrounding said base members, each of said float tubes having a specific gravity less than that of water;

each of said base members having a first arm extending upwardly therefrom;

a pair of first extension members being telescopically received in open ends of said first arms of said base members;

a pair of angled members having open upper and lower ends, said lower ends of said angled members telescopically receiving said first extension members;

a pair of second extension members being telescopically received in said upper ends of said angle members members;

a tubular central portion telescopically receiving said second extension members;

said first extension members each having a row of apertures extending therealong, each of said first arms having an aperture therethrough positioned towards said open ends thereof, a pair of pins extending through said apertures of said first arms and said first extension members for preventing sliding of said first extension members with respect to said first arms;

each of said angled members having an aperture therethrough positioned towards said lower ends thereof, a second pair of pins extending through said apertures of said angled arms and said first extension members for preventing sliding of said first extension members with respect to said angled arms;

said second extension members each having a row of apertures extending therealong, each of said angled members having a hole therethrough positioned towards said upper ends thereof, a third pair of pins extending through said holes of said angled members and said apertures of said second extension members for preventing sliding of said second extension members with respect to said angled members;

said central portion having a pair of apertures therethrough positioned towards opposite ends thereof, a fourth pair of pins extending through said apertures of said angled arms and said first extension members for preventing sliding of said second extension members with respect to said central portion; and each of said first arms having a loop coupled thereto adapted for receiving a tether line therethrough.

8. A support device for suspending a pool cover above a surface of water, the device comprising:

a pair of spaced apart base members;

a pair of float tubes surrounding said base members, each of said float tubes having a specific gravity less than that of water;

each of said base members having a first arm extending upwardly therefrom;

a pair of angled members coupled to said base members;

a central portion coupled to said angled members; and a pair of second extension members being telescopically received in open upper ends of said angle members, said central portion telescopically receiving said second extension members.

9. The support device of claim 8, wherein said base members extend generally horizontally and are oriented generally parallel each other.

10. The support device of claim 8, wherein said second extension members each have a row of apertures extending therealong, each of said angled members having a hole therethrough positioned towards said upper ends thereof, a third pair of pins extending through said holes of said angled members and said apertures of said second extension members for preventing sliding of said second extension members with respect to said angled members, said central portion having a pair of apertures therethrough positioned towards opposite ends thereof, a fourth pair of pins extending through said apertures of said angled arms and said first extension members for preventing sliding of said second extension members with respect to said central portion.

11. The support device of claim 8, wherein each of said first arms has a loop coupled thereto adapted for receiving a tether line therethrough.

* * * * *